United States Patent [19]

Fleetwood et al.

[11] 4,095,571

[45] Jun. 20, 1978

[54] FILTERING AND MIXING APPARATUS

[75] Inventors: Willard Eugene Fleetwood, Seymour; Ronald Dean Boyd, North Vernon, both of Ind.

[73] Assignee: Cummins Engine Company, Inc., Columbus, Ind.

[21] Appl. No.: 714,945

[22] Filed: Aug. 16, 1976

[51] Int. Cl.[2] ..... F02M 59/00; F02B 3/00

[52] U.S. Cl. ..... 123/136; 123/198 C; 137/604; 210/251

[58] Field of Search ..... 123/136, 198 C; 137/604; 259/4; 210/251

[56] References Cited

U.S. PATENT DOCUMENTS 1,227,881 5/1917 Bruckner ..... 137/604

3,929,645 12/1975 Bugelski et al. ..... 210/251

*Primary Examiner*—Ronald B. Cox

*Attorney, Agent, or Firm*—Gary M. Gron; Robert T. Ruff

[57] ABSTRACT

A device used to recycle used engine lubricating oil for addition to the fuel oil burned by a compression ignition engine includes a pump for pumping used lubricating oil from the engine sump. A filter removes contaminates from the oil before it is pumped to a chamber where it is mixed with fuel oil supplied by another pump and fed to the engine fuel tank. Pressure reducing orifices between the pumps and the mixing chamber insure that both pumps will operate to pump liquid regardless of the operation of the other pump.

8 Claims, 3 Drawing Figures

FILTERING AND MIXING APPARATUS

Figure 1:
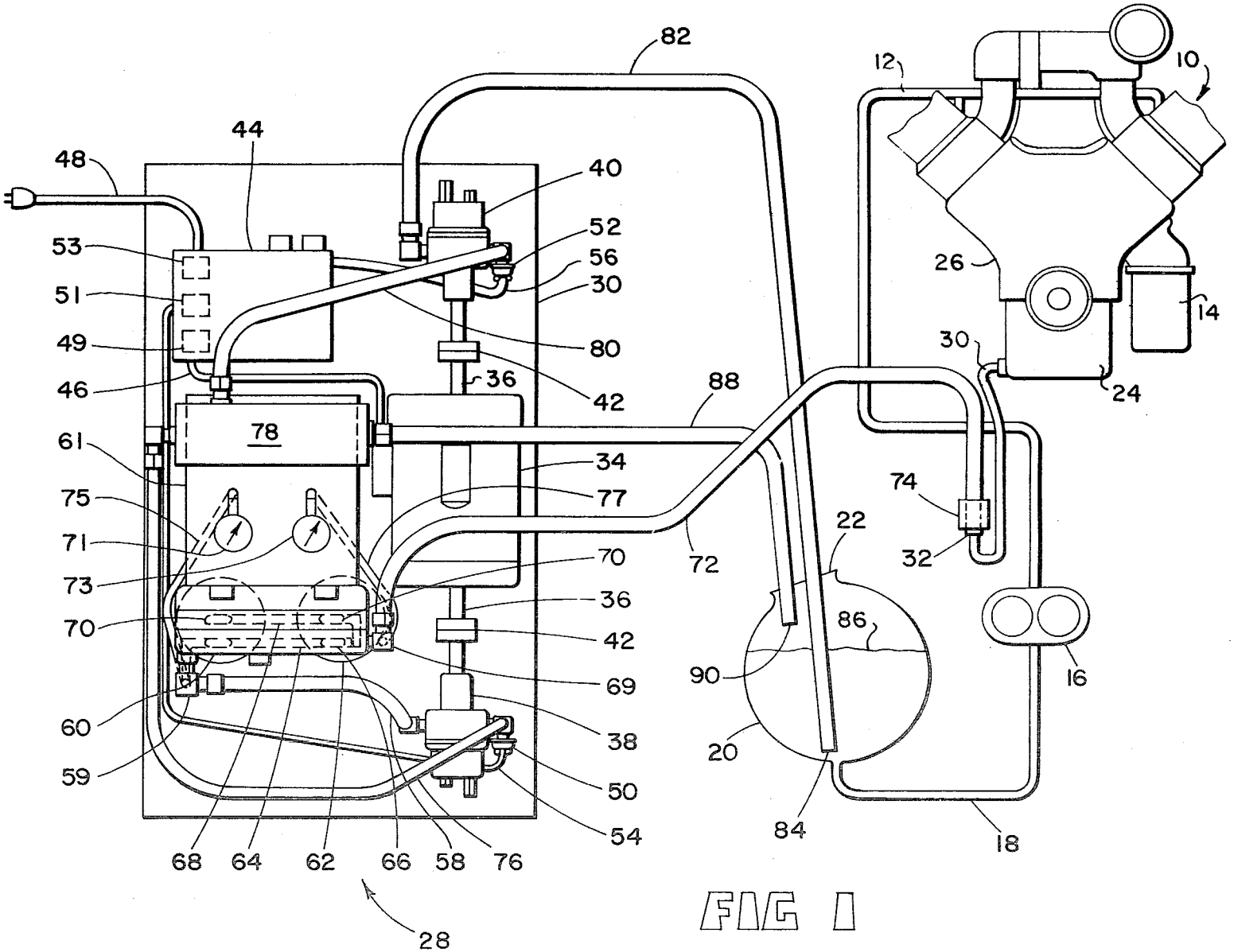

In recent years a number of proposals have been made to recycle used engine lubricating oil after appropriate treatment so that it may be added to fuel oil burned by a compression ignition engine. One earlier proposal for this may be found in U.S. Pat. No. 3,929,645, of common Assignment with the present invention. In that Patent used crankcase oil was extracted from an engine and mixed with fuel oil from the engine fuel tank before it is filtered and passed to the engine fuel tank for comsumption. This device generally is effective in accomplishing proper mixing and filtering of oil for suitable consumption by the engine. Under certain conditions; however, problems in its operation may be experienced. The output of the lubricating oil and fuel oil pump are directly connected. As a result, priming of one pump before the other can cause the output of the primed pump to prevent the other pump from passing any fluid at all. This inhibits proper mixing and operation of the device.

The above problems are solved by improvements to apparatus of the above general type which comprises a mixing means connected to the outlet of pumps which pump fuel oil and filtered, used lubricating oil. The mixing means has pressure reducing orifices at the inlets from said pumps. A conduit downstream of the orifices carry the mixed fuel oil and lubricating oil to the engine fuel oil tank.

The above and other related features of the present invention will be apparent from a reading of the following description of the disclosure shown in the accompanying drawings and the novelty thereof pointed out in the appended claims.

Figure 2:
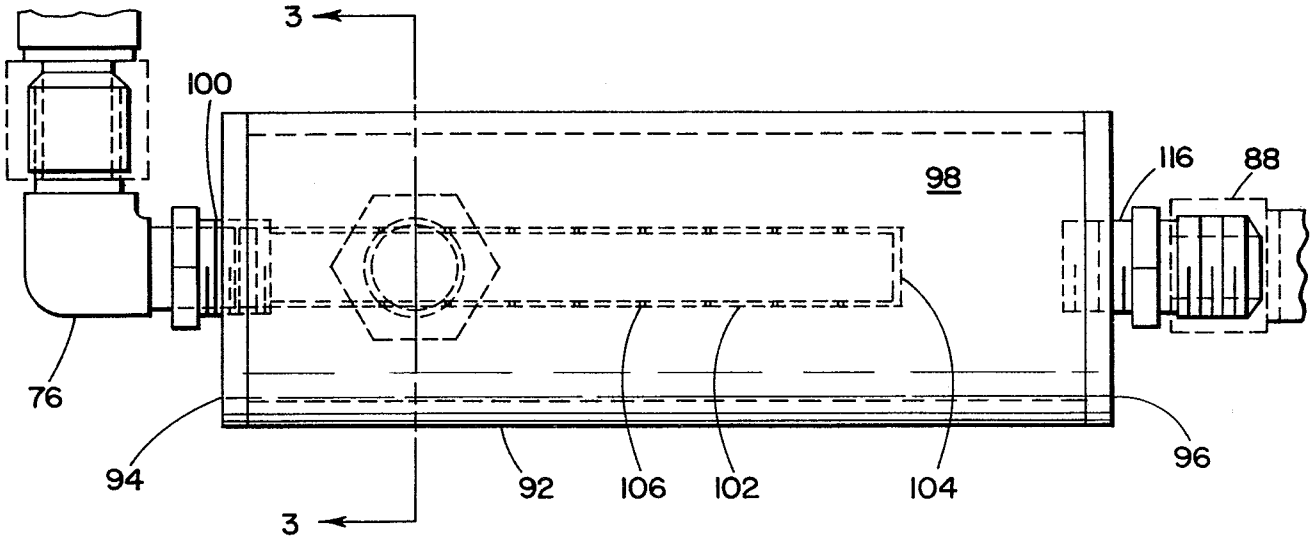
Figure 3:
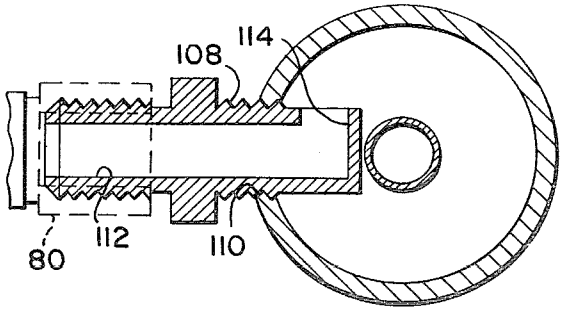

In the drawings:

FIG. 1 shows a filtering and mixing apparatus embodying the present invention along with a compression ignition engine illustrated in highly simplified form, FIG. 2 is a longitudinal section view of a mixer incorporated in the apparatus of FIG. 1, and FIG. 3 is a cross-sectional view of the mixer of FIG. 2 taken on lines 3—3 of FIG. 2.

The drawing shows a compression ignition engine 10 that uses fuel oil delivered in appropriate quantity from a supply line 12. The operating principles of the compression ignition engine and the manner in which fuel oil is metered to the individual cylinders is so well known by those skilled in the art that details of these components will not be discussed to simplify the following description. The fuel supply line 12 receives pressurized fuel from an engine driven pump 16. A fuel line 18 extends to a fuel storage tank 20 having a filler opening 22. If engine 10 is used to power a vehicle, the fuel tank would be mounted at some point on the vehicle. If engine 10 is used in a stationary installation, both the fuel tank and engine would be permanently mounted, although not necessarily on the same base.

Engine 10 has a lubricating system in which oil is pressurized by a pump (not shown) for delivery through a filter 14 to suitable passages for lubricating the rotating parts in the engine. The oil then is returned to a sump 24 secured to the bottom of the engine crankcase 26.

In accordance with the present invention, the apparatus designated by number 28 removes used lubricating oil from the engine sump 24 and then adds it to the fuel tank 20 to be burned with fuel oil by engine 10. To utilize this system, engine sump 24 preferably is fitted with a flexible hose or conduit 30 extending from a low point in the sump 24 to a quick disconnect fitting 32 located at a point permitting ready access. In many cases, it would be possible to connect the flexible hose 30 to the sump 24 at the fitting that receives the usual drain plug.

The apparatus 28 comprises a base 30 which provides support for the various elements of the system 28. Wheels (not shown) may be provided to give the base mobility. The apparatus includes a motor 34 mounted on base 30. The motor has an output shaft 36 driving pumps 38 and 40 (also mounted on base 30) through suitable flexible couplings 42. As illustrated, pumps 38 and 40 are gear pumps but other types may be used with equal results. Typical gear pumps suitable for use are ones manufactured by Sherwood under model number BBU 3&4. Motor 34 may be any suitable type providing sufficient shaft horsepower to drive the pumps 38 and 40. As illustrated, motor 34 is an electrical motor receiving a 110 to 220 volt AC source of electricity. It should be understood that many other types of motors may be employed such as a gasoline engine, etc. If the motor 34 is electrical it receives its source of electrical power from a motor control box 44 via line 46. Line 48 extends to a suitable source of AC electricity and an operator controlled switch 49 connects electricity to line 46. Pressure switches 50 and 52 on the output side of pump 38 and 40 respectively actuate relays 51, 54 (shown schematically) in the motor control 44 via lines 53 and 56, respectively. The pressure switches 50 and 52 are set up to activate the relays to cut electrical power to motor 34 whenever the output pressure of either one of pumps 38 and 40 drops below a predetermined pressure.

Pump 38 has an inlet conduit 58 extending to a fitting 59 on filter mounting housing 60. Housing 60 is secured to a plate 61 and serves as a support for a pair of spin on filters 62. Filters 62 may be any type of spin on filter with sufficient filtration capability. Filters particulary suitable for this installation are Fleetguard filters FF 202. Manufactured by Fleetguard, Inc., Cookeville, Tennessee, these filters pass contaminated liquid through a central opening in the spin on unit and pass filtered liquid out through a section surrounding the central opening. The particular filters illustrated provide a filtration of particles down to a suitable size as required by the fuel system.

Housing 60 has an outlet passage 64 with branches 66 leading to the outlet of filters 62. Housing 60 also has an inlet passage 68 with branches 70 extending to the center of filters 62. Inlet passage of 68 leads to fitting 69 and conduit 72 having a quick disconnect fitting 74 illustrated as connected with coupling 32 for the engine oil drain line. Vacuum gauges 71, 73 connect across filters 62 through lines 75, 77 which extend to fittings 59, 69 respectively.

The output side of pump 38 has a line 76 leading to a mixer generally designated as 78. The output of pump 40 has a line 80 also leading to mixer 78. The inlet side of pump 40 has a line 82 extending to an opening 84 spaced below the level of fuel 86 within tank 20. The outlet of mixer 78 has a conduit 88 which extends to an opening 90 which discharges through opening 22 into tank 20.

Referring particularly to FIGS. 2 and 3 mixer 78 comprises a tubular element 92 having end walls 94 and 96 which define a cylindrical mixing chamber 98. Oil from conduit 76 passes through a fitting 100 in wall 94 and into a tube 102 having one end secured around fitting 100 and having the opposite end blocked off with a suitable plug 104. Tube 102 has a series of relatively small holes 106 at spaced positions along its length and around its periphery. These holes have a combined cross-sectional flow area which results in an orifice of relatively small size to produce a substantial pressure differential between the outlet of pump 38 and chamber 98.

The line 80 extends to the wall of tube 92 at a point adjacent end wall 94. A fitting 108 is positioned in opening 110 in line with conduit 80. Fitting 108 has a through passage comprised of a first passage 112 oriented in a radial direction relative to the axis A of tube 92. Passage 112 intersects a second passage 114 opening to chamber 98 in a direction tangent to the axis A of chamber 98. The minimum cross-sectional flow area of the passage made up of sections 112 and 114 is also a relatively small amount to produce a substantial pressure differential between pump 40 and chamber 98. Conduit 88 is secured to end wall 96 and receives fluid from chamber 98 through fitting 116.

During operation of apparatus 28 conduits 72, 82 and 88 are positioned as described above. Motor control 44 is energized by switch 49 to drive motor 34 and cause pumps 38 and 40 to pump used lubricating oil from engine sump 24 and fuel oil from tank 20 respectively. The lubricating oil from sump 24 passes through filters 62 for removal of contaminates prior to entering mixing chamber 78.

Vacuum gauges 71 and 73 provide a direct reading of the condition of filters 62. Whenever the differential between these gauges exceeds an appropriate level it is an indication the filters should be changed. The pumps 38 and 40 operate at the same RPM so that their relative output is equivalent. However, the size of the orifices defined at the inlet to mixing chamber 78 varied relative to one another to achieve a mixture of lubricating oil relative to fuel oil in chamber 78 at a ratio of between 3–5 to one fuel oil relative to lubricating oil. This mixture is discharged to the engine tank at an ultimate concentration of lubricating oil to fuel oil that does not exceed 5%. The ratio takes into account the total fuel into the tank and the total amount of oil extracted from engine sump 20. U.S. Pat. No. 3,929,645 contains a full description of the over all ratio.

It was pointed out before that the size of the various orifices is relatively smaller to produce a substantial pressure differential between pumps 38 and 40 and chamber 98. The reason for this is to prevent one of the pumps from feeding its output through mixing chamber 78 to the output of the other pump before the other pump ever gets a chance to start pumping its appropriate fluid. The orifices are sized so that the nominal output pressures of the pumps (for example 60 psi) are reduced to approximately 4 psi in chamber 78. Typical orifice sizes which achieve the above results are approximately 0.0115 square inch for pump 50 and 0.0415 square inch for pump 40. This ensures that even if pump 40 begins to pump fuel oil from tank 20 before pump 38 is primed and begins pumping lubricating oil from the engine sump 24 the output of pump 40 will not feed back through mixing chamber to prevent pump 38 from ever pumping lubricating oil.

Once liquid flow has been established from pumps 38 and 40 their output is discharged through the pressure reducing orifices into chamber 98. The oil is discharged radially from tube 102 and the fuel oil is discharged tangentially from feeding 108. The fuel oil begins a spiral flow path from one end to the other of chamber 98. As it traverses chamber 98 it is substantially mixed with the streams of lubricating oil passing from opening 106. This spiral and radial mixing of the fluids ensures a highly effective mixing of lubricating oil with the fuel oil. The mixed product is discharged through line 88 into tank 20 for use in the engine fuel system.

The motor 34 continues to operate until pump 38 or pump 40 exhausts the containers they are pumping from. In the normal course of events the engine sump chamber 24 will be deleted since the contents are being transferred to tank 20. When pump 38 no longer has oil to pump its output will drop to a negligible value. When this occurs pressure switch 50 will activate the relay 51 in the motor control 44 to terminate electrical power to motor 34. Therefore the apparatus is automatically shut off when the used lubricating oil has been removed from the engine crankcase. When this is finished the various hoses are removed and the engine oil supply replenished in the normal fashion.

The above apparatus is highly effective in removing, filtering and recycling lubricating oil from he crankcase of a compression ignition engine. While a specific embodiment of the invention has been described it should be apparent to those skilled in the art that it may be practiced in other forms without departing from the spirit and scope of it.

Having thus described the invention what is claimed as novel and desired to be secured by letters patent of the United States is:

1. Apparatus for addition of liquid lubricating oil to liquid fuel oil used by an internal combustion engine, said apparatus comprising:

first conduit means having one end extendable to a supply of lubricating oil;

first pump means for pumping lubricating oil through conduit means, filter means interposed in said first conduit means for filtering contaminates from said lubricating oil;

second pump means for pumping fuel oil;

means defining a mixing chamber having inlets connected to receive the output of said first and second pump means for mixing said lubricating oil with said fuel oil, said mixing chamber means having means defining orifices in said inlets for producing a substantial pressure differential between the output of said pumps and said mixing means to increase the velocity of said liquids, said orifices oriented to discharge said liquids into said chamber in a direction promoting substantial mixing with one another; and conduit means connected to said mixing means downstream of said orifices for discharging the output thereof to a tank of fuel oil for use by said engine.

2. Apparatus for addition of lubricating oil to fuel oil used by an internal combustion engine, said apparatus comprising:

first conduit means having one end extendable to a supply of lubricating oil;

first pump means connected to the other end of said conduit means for pumping lubricating oil from conduit means, filter means interposed in said first conduit means for filtering contaminates from said lubricating oil;

second pump means for pumping fuel oil;

mixing means defining a mixing chamber, said mixing chamber having a generally cylindrical form and an inlet at one end for the output of one of said pumps and a tangentially directed inlet for the output of the other of said pumps to provide substantial mixing of said lubricating oil with said fuel oil, said mixing means having means defining orifices in said inlets for producing a substantial pressure differential between the output of said pumps and said mixing means; and conduit means connected to said mixing means downstream of said orifices for discharging the output thereof to a tank of fuel oil for use by said engine.

3. Apparatus as in claim 2 wherein the inlet at one end of said chamber is connected to the outlet of said first pump means and the tangentially directed inlet is connected to the output of said second pump means.

4. Apparatus as in claim 3 wherein said orifice means comprises a tube extending from said inlet at one end in an axial direction through said cylindrical chamber, said tube having the free end thereof closed and a plurality of relatively small openings at spaced positions along said tube thereby forming the orifices for said lubricating oil uniformly distributing oil throughout said mixing chamber.

5. Apparatus as in claim 4 wherein said orifice means comprises a plug extending radially through the curved wall of said mixing chamber, said plug having a relatively small inlet passage directed radially with respect to the axis of said chamber and an outlet directed tangentially with respect to said axis thereby forming said orifice for said fuel oil.

6. Apparatus as in claim 2 wherein said central inlet is at one end of said mixing chamber and said outlet is at the opposite end of said chamber, said tangentially directed inlet positioned adjacent the inlet end of said chamber.

7. Apparatus as in claim 1 further comprises vacuum gauges connected to the upstream and downstream side of said filter for indicating when said filter is clogged with contaminates.

8. Apparatus as in claim 1 further comprising:

motor means connected to and driving said first and second pump means;

motor control means including means for terminating operation of said motor in response to control signals; and, means connected to the output of said first and second pumps for generating a control signal applied to said motor control means for terminating operation of said motor whenever the output pressure of one of said pumps is below a predetermined pressure.

* * * * *